United States Patent [19]

Moog

[11] 4,202,238

[45] May 13, 1980

[54] COMPRESSOR-EXPANDER FOR A MUSICAL INSTRUMENT

[75] Inventor: Robert A. Moog, East Aurora, N.Y.

[73] Assignee: Norlin Industries, Inc., Lincolnwood, Ill.

[21] Appl. No.: 911,476

[22] Filed: Jun. 1, 1978

[51] Int. Cl.[2] ..... G10H 1/02

[52] U.S. Cl. ..... 84/1.27; 84/1.09; 84/1.24; 330/282; 330/295; 333/14

[58] Field of Search ..... 84/1.09, 1.1, 1.24, 84/1.27; 330/278, 295, 136, 282; 333/14

[56] References Cited

U.S. PATENT DOCUMENTS

| | | | |
|---|---|---|---|
| 3,735,290 | 5/1973 | Yamazaki | 333/14 |
| 4,054,849 | 10/1977 | Yamada | 330/278 |
| 4,114,115 | 9/1978 | Minnis | 333/14 |

FOREIGN PATENT DOCUMENTS

| | | | |
|---|---|---|---|
| 1385493 | 2/1975 | United Kingdom | 333/14 |

*Primary Examiner*—Gene Z. Rubinson
*Assistant Examiner*—Forester W. Isen
*Attorney, Agent, or Firm*—Allegretti, Newitt, Witcoff & McAndrews

[57] ABSTRACT

Electrical circuitry for varying the relative distinctiveness between the lead and rhythm audio signals produced by an electrical guitar, or the like, according to the strength with which the musician picks the guitar strings. The rhythm signal is compressed in response to how hard the player strums or picks the guitar, while the lead signal is expanded as a direct function of rhythm signal compression. An electrical signal is generated from the rhythm signal for controlling the extent of compression and expansion of the audio signals.

27 Claims, 6 Drawing Figures

Fig. 1
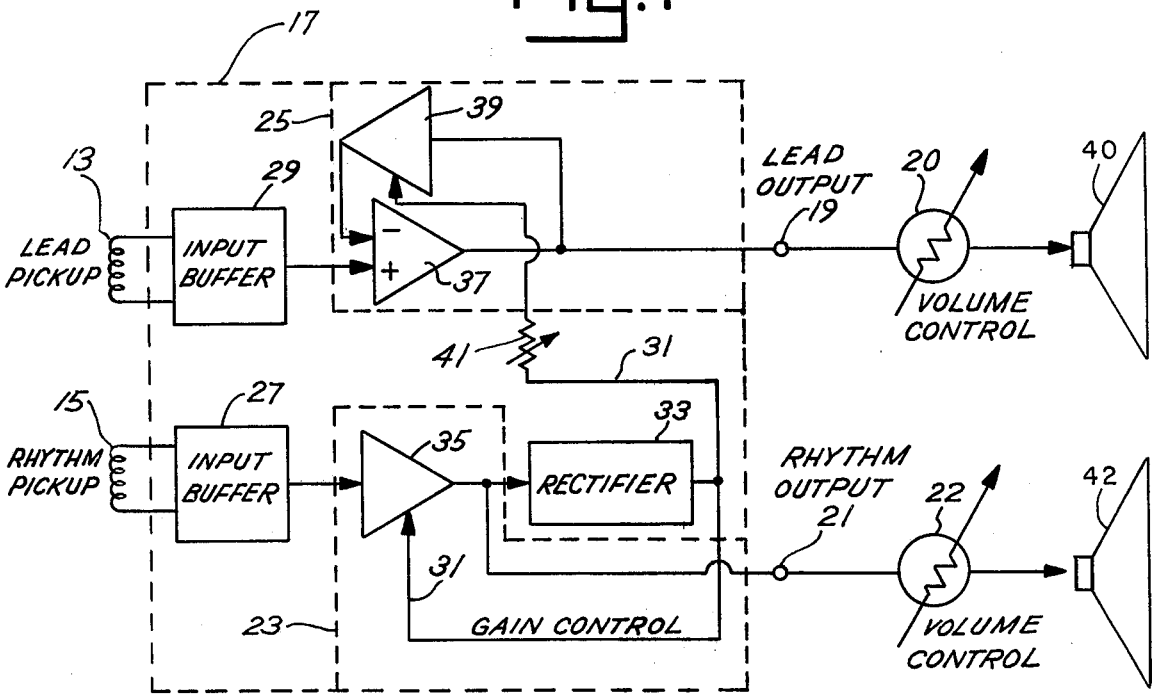
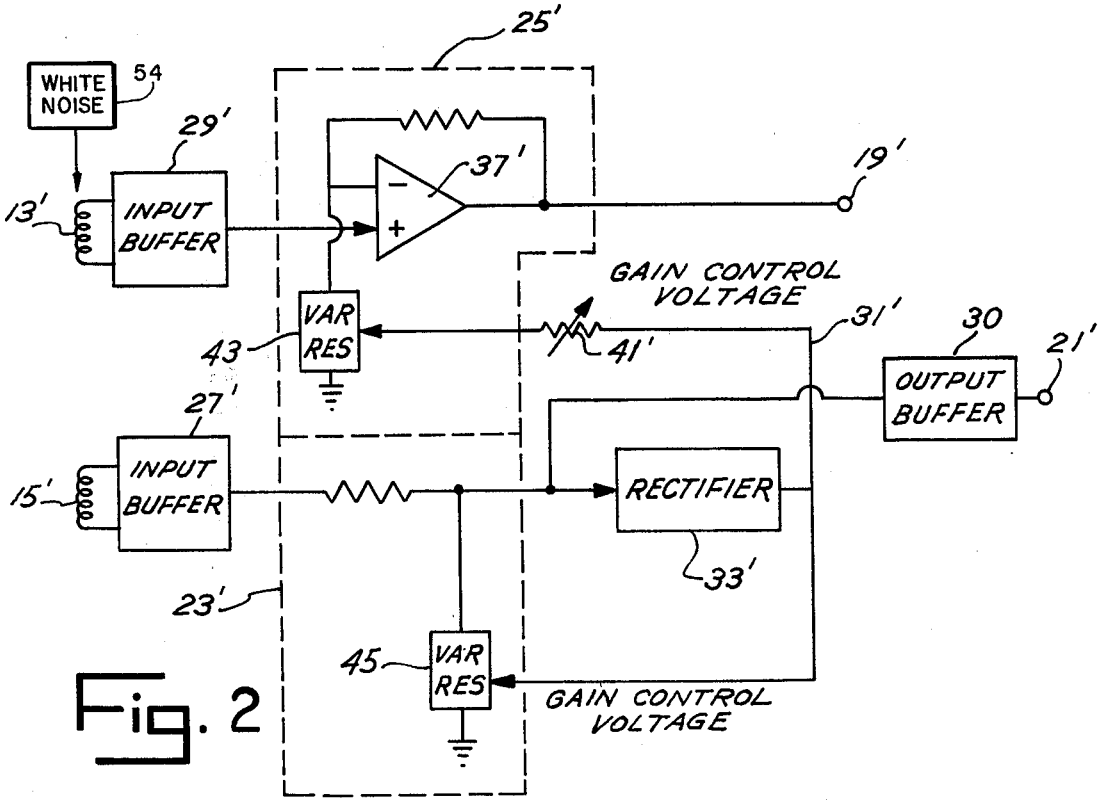
Fig. 2

EXPANDER 25'''

COMPRESSOR-EXPANDER FOR A MUSICAL INSTRUMENT

BACKGROUND OF THE INVENTION

The present invention relates to apparatus for modifying the audio output signal from a musical instrument, and more particularly relates to electrical circuitry for modifying the audio output signal from a guitar in accordance with the strength of vibration activated by the musician.

Heretofore, electrical circuitry has been provided for varying and modifying the output audio signal from an electric guitar prior to the signal's conversion to audible sound. Such electrical circuitry may include various control features manually adjustable by the musician to establish the type of modification to be applied to the audio signal. For example, the treble or the bass of the produced sound may be increased or decreased by adjusting a control knob.

However, it is difficult, if not impossible, for the musician to vary the type and degree of modification of the produced sound during his actual playing. Practically speaking, all control adjustments are set prior to playing, otherwise, the musician must discontinue playing, at least with one hand, to provide additional modifications and readjustments.

SUMMARY OF THE INVENTION

It is, therefore, an object of the present invention to permit a musician to control the dynamic response of an electric guitar simply by the strength of play on the guitar strings. The invention allows the musician to determine whether the tone is sustained and muted or percussive and bright, continually throughout the play of the music according to how hard he plays. Furthermore, the invention permits inclusion of level controls permitting the musician further adjustment of the response of the instrument.

Accordingly, this invention provides electrical circuitry for receiving and modifying audio output signals from a musical instrument. A signal compressor and expander operate on signals from the instrument to respectively compress and expand the signals. The extent of signal compression and signal expansion is controlled by an electrical signal generated in relation to the magnitude of audio signal from the musical instrument.

Other objects, features and advantages of the present invention will be readily apparent from the following description of preferred embodiments taken in conjunction with the appended claims, and accompanying drawings.

BRIEF DESCRIPTION OF THE DRAWINGS

FIG. 1 is a block diagram representation of an electrical circuitry embodiment of the present invention.

FIG. 2 is a block diagram representation of a second circuitry embodiment of the present invention.

DESCRIPTION OF PREFERRED EMBODIMENTS

Figure 3:
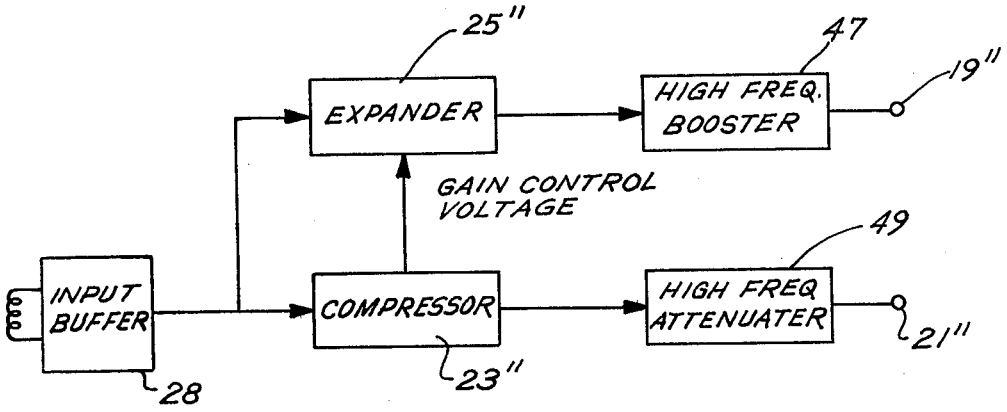
FIG. 3 is a block diagram representation of a third circuitry embodiment of the present invention.

Referring to FIG. 1, a pair of transducers, as for example, string signal pickups 13, 15 are secured to an electric guitar (not shown) for receiving separate electrical signals produced by the guitarist strumming or picking the guitar strings. Pickup 13 receives the "lead" pickup signal which comes from the portion of the strings nearest the bridge, and therefore contains a high proportion of high harmonics, and pickup 15 receives the "rhythm" pickup signal which comes from a portion of the strings far from the bridge and therefore contains a low-proportion of high harmonics.

The electrical signals received by pickups 13, 15 pass through an electrical circuit 17 and are transformed to respective output signals at output nodes 19, 21. Circuit 17 transforms the pickup signals such that a strong playing on the guitar strings by the guitarist produces a louder more amplified music signal from the lead signal at lead output node 19 than from the rhythm signal at rhythm output node 21, whereas a lighter touch to the guitar strings produces a more amplified music signal from rhythm output node 21 than from lead output node 19. The guitarist is therefore able to control the distinctiveness or percussiveness of the music played according to the strength of his touch.

Circuit 17 includes a compressor circuit 23 and an expander circuit 25. Compressor circuit 23 receives the rhythm music signal from pickup 15 via an input buffer 27 and "compresses," i.e., decreases the dynamic range of the rhythm signal, producing the compressed rhythm signal at output node 21. Expander circuit 25 receives the lead signal from pickup 13 via an input buffer 29 and "expands," i.e., increases the dynamic range of the lead signal, producing the expanded lead signal at output node 19.

The extent of respective compression and expansion performed by compressor circuit 23 and expander circuit 25 is controlled by an electrical signal generated along line 31 which interconnects the two circuits 23, 25. The magnitude of the electrical signal generated along line 31 is related to the magnitude of the audio signal produced by the musician.

The electrical signal of line 31 is produced by a rectification of the output of compressor 23 via rectifier 33. The magnitude of the resultant rectified voltage determines the magnitude of compression and expansion.

Compression circuit 23 includes a variable gain amplifier 35 for receiving and amplifying the rhythm signal from pickup 15. The extent of amplification by amplifier 35 is voltage controlled by the signal fed along line 31. In the absence of a voltage along line 31, the gain of amplifier 35 is at a maximum.

The output of variable gain amplifier 35 is rectified via rectifier 33 for producing the voltage signal along line 31. The magnitude of the rectified voltage determines the degree of reduction in the gain of amplifier 35. The greater the signal output from amplifier 35 the greater the reduction in its amplification.

Expander circuit 25 includes an operational amplifier (op amp) 37 receiving at its non-inverting input the lead signal from pickup 13 for amplifying the lead signal to produce an output at node 19. The output from op amp 37 is fed back to its inverting input for controlling amplification. A variable gain amplifier 39 is positioned in the feedback path for amplifying the feedback signal prior to its entering the inverting input node. The gain of variable gain amplifier 39 is controlled by the voltage signal along line 31, such that the gain of operational amplifier 37 changes in a direction opposite from that of compressor circuit 23. That is, the expander circuit 25 expands the dynamic range of the signal from the lead pickup 13 while compressor circuit 23 compresses the dynamic range of the signal from rhythm pickup 15, both in relation to the voltage along line 31.

A variable resistor 41 connected along the control line 31 between rectifier 33 and variable gain amplifier 39 is variable for determining the amount of control voltage fed to amplifier 39 and therefore determining the amount of lead signal expansion relative to rhythm signal compression. The resistor 41 may be manually adjustable by the musician for controlling the degree of lead signal expansion in relation to rhythm signal compression.

Because the lead signal contains more high frequency content than the rhythm signal, the expanded lead signal will sound brighter than the compressed rhythm signal. This serves to increase the differentiation between the compressor and expander outputs, thereby enhancing the range of dynamic response available to the performer.

The output signal from lead output node 19 and rhythm output node 21 may feed level controls 20, 22 respectively, to provide independent control of the amplitude of the lead and rhythm outputs at nodes 19, 21. This allows further control by the musician to adjust the response of the musical instrument. The output of level controls 20, 22 may drive separate speakers 40, 42 or may be combined through a simple mixing network prior to input to a speaker system. To aurally differentiate the two output signals of nodes 19, 21, conventional frequency-sensitive networks, as for example filter circuits, may be inserted in the separate signal paths before the mixing network.

A second embodiment is illustrated in FIG. 2, wherein like components of FIG. 1 are designated by like reference numerals with a single prime mark. The second embodiment utilizes voltage variable resistance elements 43, 45 in place of variable gain amplifiers 39, 35, respectively, of FIG. 1. Resistive elements 43, 45 may be formed, for example, from field effect transistors. The circuit of FIG. 2 provides an advantage over the circuit of FIG. 1 in that voltage variable resistors produce less noise than variable gain amplifiers.

The gain control voltage along line 31' of FIG. 2 is fed to variable resistors 43, 45 for controlling their resistive value. Thus, as the input signal to rectifier 33' increases, the resistances of variable resistors 43, 45 decreases, serving to shunt the electrical signal applied across resistors 43, 45. Thus, the rhythm signal at output node 21' is lowered, and the feedback signal of op amp 37' is shunted to ground thereby increasing the throughput gain of op amp 37' amplifying the lead signal output at node 19'.

A third embodiment is illustrated in FIG. 3, wherein a composite output from an electric guitar may be utilized with the present invention. The composite signal is fed to separate inputs of expander circuitry 25'' and compressor circuitry 23'' via an input buffer 28. A high frequency booster 47 receives the output from expander circuit 25'' for boosting the high frequency output of the expander, while the high frequency portion of the output of compressor 23'' is attenuated by a high frequency attenuator 49. This provides timbral (tone color) differentiation between the two signals.

Figure 4A:
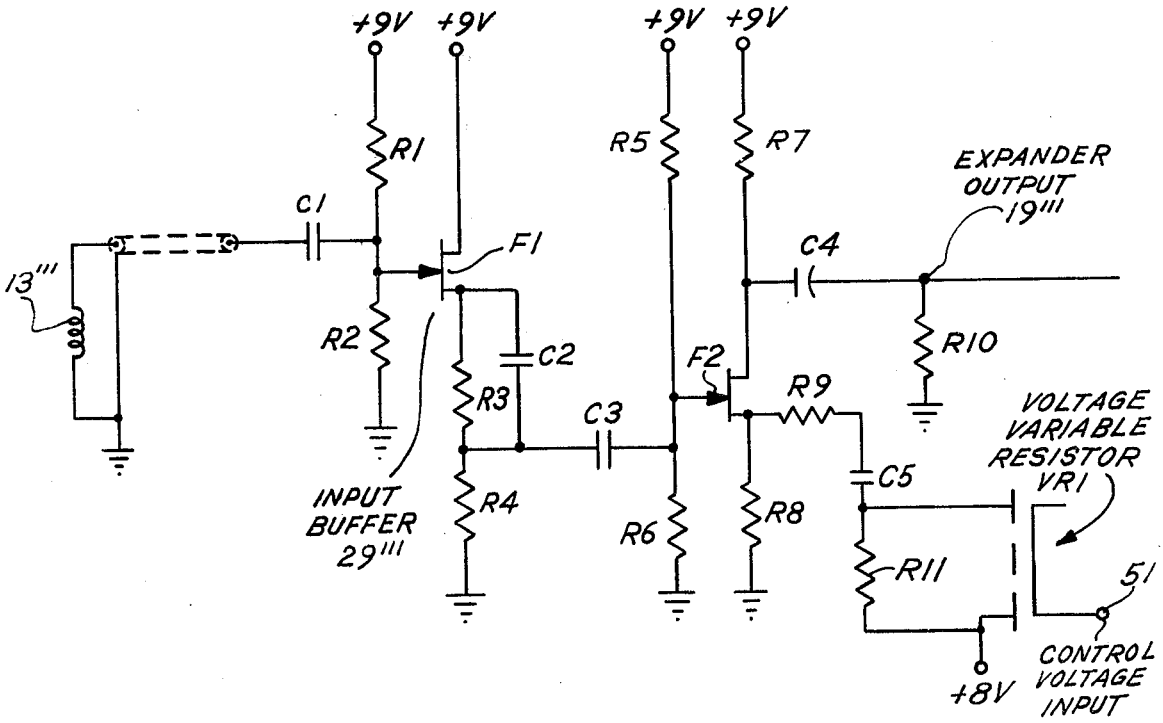
FIGS. 4A–C are schematic diagrams of expander, compressor and rectifier circuits, respectively, of a fourth circuitry embodiment of the present invention.
Figure 4B:
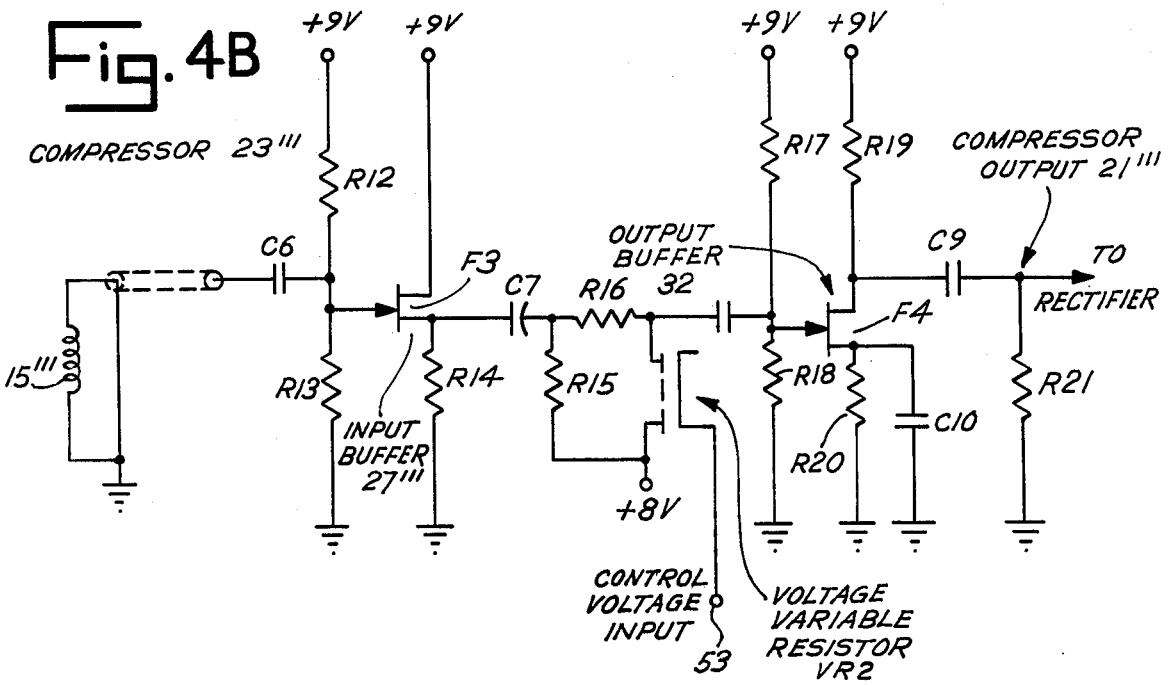
Figure 4C:
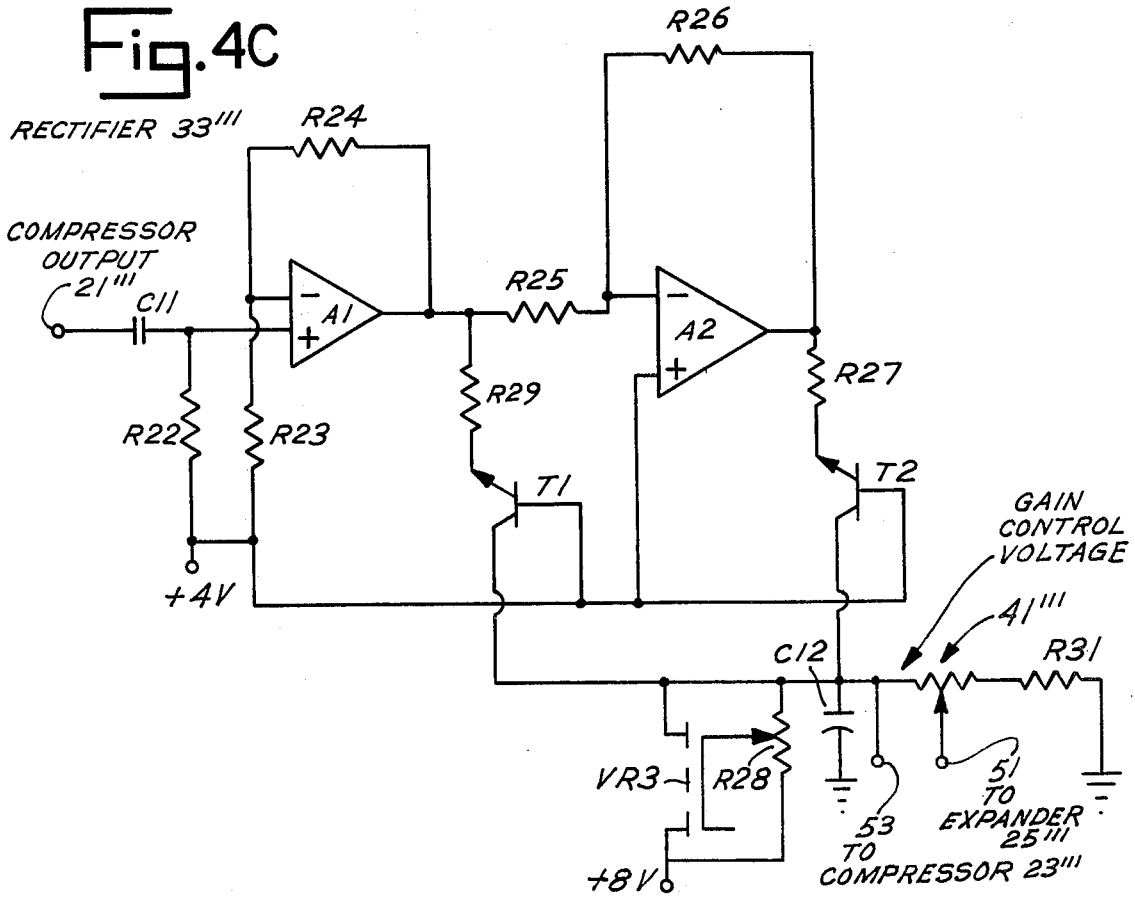

FIGS. 4A–4C illustrate schematic diagrams of a fourth circuitry embodiment in which voltage variable resistors are utilized to control gain. The circuitries are comprised of resistors R1–R31, capacitors C1–C12, field effect transistors (FETS) F1–F4, transistors T1–T2, op amps A1, A2 and voltage variable resistors VR1–VR3.

Referring to FIG. 4A, an expander circuit is illustrated in conjunction with lead pickup 13''' and input buffer 29''' which is formed from FET F1. FET F2 expands the lead signal from buffer 29 at a gain determined by voltage variable resistor VR1. The dynamic resistance of resistor VR1 is varied by the gain control voltage at input 51, shunting the signal across resistor R9 to decrease the effective source resistance of FET F2.

Referring to FIG. 4B, a compressor circuit is illustrated in conjunction with rythm pickup 15''' and input buffer 27''' which is formed from FET F3. Voltage variable resistor VR2 serves to compress the rhythm signal from buffer 27''' by controlling the shunting of the rythm signal to ground prior to its entering output buffer 32 (output buffer 32 may be connected alternatively in like fashion as output buffer 30 shown in FIG. 2). The dynamic resistance of resistor VR2 is varied by the gain control voltage at input 53.

Referring to FIG. 4C, the rectifier 33''' is illustrated receiving as its input the compressor output signal from node 21'''. The compressor output signal is first amplified by op amp A1 and then inverted by op amp A2. Transistors T1, T2 conduct on alternative half cycles, thereby functioning as a full wave rectifier to charge capacitor C12. The voltage across capacitor C12 is applied directly to node 53 to control the compressor 23'''. The voltage across capacitor C12 is also applied through sensitivity adjustment resistor R32 to node 51, to control expander 25'''. A voltage variable resistor VR3 is utilized in the rectifier circuit to increase the discharge rate of capacitor C12 when the gain control signal exceeds a threshold which is set by resistor R28, thereby minimizing the "dead time" in the recovery of the compressor after a loud note is sounded.

Other applications for the circuitry embodiments of FIGS. 1–4 include the feeding of a separate and distinct signal not coming from the musical instrument into either the expander or compressor inputs. For example, white noise (as illustrated by diagram block 54) can be fed to the expander input for adding an exaggerated "noise attack" to loudly played tones.

It should be understood, of course, that the foregoing disclosure relates to preferred embodiments of the invention and that other modifications or alterations may be made therein without departing from the spirit or scope of the invention as set forth in the appended claims.

What is claimed is:

1. Apparatus for controlling the output sound of a musical instrument according to the strength of sound produced by the musician, comprising:

transducer means for generating first and second audio signals in response to the playing of the instrument;

control signal means for producing a control signal whose magnitude is related to the strength of sound produced by the musician;

signal compressor means for receiving the first audio signal and generating a compressed output thereof, said compressor means responsive to said control signal for providing compression of said first audio signal according to said control magnitude; and signal expander means for receiving the second audio signal in substantial time coincidence with receipt of said first audio signal by said signal compressor means and generating an expanded output of said second audio signal, said expander means responsive to said control signal for providing expansion of said second audio signal according to the control signal magnitude.

2. Apparatus according to claim 1 wherein said transducer means includes:

first transducing means for transducing a first proportion of a range of harmonics playable by the musical instrument to said first audio signal; and second transducing means for transducing a second proportion of said range of harmonics playable by the musical instrument to said second audio signal.

3. Apparatus according to claim 1 and further including:

first level control means connected to said signal compressor means for receiving and amplifying said compressed output, said first level control means manually adjustable for controlling the extent of amplification of said compressed output; and second level control means connected to said signal expander means for receiving and amplifying said expanded output, said second level control means manually adjustable for controlling the extent of amplification of said expanded output.

4. Apparatus according to claim 1 wherein said transducer means includes:

first signal pick-up means for picking up lead signals from the musical instrument for producing said first audio signal; and second signal pick-up means for picking up rhythm signals from the musical instrument for producing said second audio signal.

5. Apparatus according to claim 1, and further including manually-operable control means for receiving said control signal and permitting manual varying of said control signal magnitude thereof, said control means connected between said control signal means and said signal expander means for passing the control signal having a varied signal characteristic to said expander means; and wherein said expander means is responsive to the control signal passed from said control means for providing a magnitude of expansion of said second audio signal according to the varied signal characteristic.

6. Apparatus for controlling the output sound of a musical instrument according to the strength of sound produced by the musician, comprising:

control signal means for producing a control signal whose magnitude is related to the strength of sound produced by the musician;

signal compressor means for receiving a composite signal and generating a compressed output thereof, said compressor means responsive to said control signal for providing compression of the composite signal according to said control signal magnitude;

signal expander means for receiving the composite signal and generating an expanded output thereof, said expander means responsive to the control signal for providing expansion of the composite signal according to the control signal magnitude.

7. Apparatus according to claim 6, and further including:

means for imparting a first frequency characteristic response to the expanded output of said expander means;

means for imparting a second frequency characteristic response to the compressed output of said compressor means, said first frequency characteristic response being different from said second frequency characteristic response.

8. Apparatus according to claim 4, wherein said control signal is a voltage.

9. Apparatus according to claim 4, wherein said signal compressor means includes variable gain amplifier means for receiving said first audio signal, the gain of said amplifier means being variable according to the magnitude of said control signal.

10. Apparatus according to claim 9, wherein said control signal means includes rectifier means for receiving the output of said variable gain amplifier means, for producing said control signal.

11. Apparatus according to claim 8, wherein said signal compressor means includes a voltage variable resistor.

12. Apparatus according to claim 11, wherein said voltage variable resistor is a FET device.

13. Apparatus according to claim 8, wherein said signal expander means includes a voltage variable resistor.

14. Apparatus according to claim 13, wherein said variable resistor is a FET device.

15. Apparatus according to claim 4, wherein said signal expander means includes:

operational amplifier means for receiving at its non-inverting input said second audio-signal; and variable gain amplifier means for receiving the output of said operational amplifier means as in input, said variable gain amplifier means producing an output feeding the inverting input of said operational amplifier, and the gain of said variable gain amplifier means being variable according to the magnitude of said control signal.

16. Apparatus according to claim 6 and further including transducing means for transducing an output sound of the musical instrument to the composite signal.

17. Apparatus according to claim 6, and further including manually-operable control means for receiving said control signal and permitting manual varying of said control signal magnitude thereof, said control means connected between said control signal means and said signal expander means for passing the control signal having a varied signal characteristic to said expander means; and wherein said expander means is responsive to the control signal passed from said control means for providing a magnitude of expansion of said composite signal according to the varied signal characteristic.

18. Apparatus according to claim 6, wherein said control signal is a voltage.

19. Apparatus according to claim 6, wherein said signal compressor means includes variable gain amplifier means for receiving said composite signal, the gain of said amplifier means being variable according to the magnitude of said control signal.

20. Apparatus according to claim 19, wherein said control signal means includes rectifier means for receiving the output of said variable gain amplifier means, for producing said control signal.

21. Apparatus according to claim 18, wherein said signal compressor means includes a voltage variable resistor.

22. Apparatus according to claim 21, wherein said voltage variable resistor is a FET device.

23. Apparatus according to claim 18, wherein said signal expander means includes a voltage variable resistor.

24. Apparatus according to claim 23, wherein said variable resistor is a FET device.

25. Apparatus according to claim 6, wherein said signal expander means includes:

operational amplifier means for receiving at its non-inverting input said composite signal; and variable gain amplifier means for receiving the output of said operational amplifier means as an input, said variable gain amplifier means producing an output feeding the inverting input of said operational amplifier, and the gain of said variable gain amplifier means being variable according to the magnitude of said control signal.

26. Apparatus for generating an output sound of a musical instrument according to the strength of play performed by the musician, comprising:

control signal means for producing a control signal whose magnitude is related to the strength of play performed by the musician;

signal compressor means for receiving a first audio signal and generating a compressed output thereof, said compressor means responsive to said control signal for providing compression of said first audio signal according to said control signal magnitude;

signal expander means for receiving a second audio signal and generating an expanded output thereof, said expander means responsive to said control signal for providing expansion of said second audio signal according to the control signal magnitude; and speaker means for receiving said compressed output signal and said expanded output signal and for responsively generating sound.

27. Apparatus for controlling the output sound of a musical instrument according to the strength of sound produced by the musician, comprising:

control signal means for providing a control signal whose magnitude is related to the strength of sound produced by the musician;

signal compressor means for receiving a first audio signal and generating a compressed output thereof, said compressor means responsive to said control signal for providing compression of said first audio signal according to said control magnitude;

signal expander means for receiving a second audio signal in substantial time coincidence with receipt of said first audio signal by said signal compressor means and generating an expanded output of said second audio signal, said expander means responsive to said control signal for providing expansion of said second audio signal according to the control signal magnitude; and wherein said second audio signal is a noise signal.

* * * * *